US012295484B2

(12) United States Patent
Weinreich

(10) Patent No.: US 12,295,484 B2
(45) Date of Patent: May 13, 2025

(54) MULTI-FUNCTION LAWN HOLDERS

(71) Applicant: Benjamin Weinreich, Sykesville, MD (US)

(72) Inventor: Benjamin Weinreich, Sykesville, MD (US)

( * ) Notice: Subject to any disclaimer, the term of this patent is extended or adjusted under 35 U.S.C. 154(b) by 0 days.

(21) Appl. No.: 18/240,606

(22) Filed: Aug. 31, 2023

(65) Prior Publication Data

US 2024/0065423 A1 Feb. 29, 2024

Related U.S. Application Data

(60) Provisional application No. 63/402,542, filed on Aug. 31, 2022.

(51) Int. Cl.
*A45F 3/44* (2006.01)
*A45F 3/24* (2006.01)

(52) U.S. Cl.
CPC ..... *A45F 3/44* (2013.01)

(58) Field of Classification Search
CPC ..... A45F 3/44; E04H 12/2215; A01G 9/122
USPC ..... 248/156, 121
See application file for complete search history.

(56) References Cited

U.S. PATENT DOCUMENTS 854,178 A * 5/1907 Ruff ..... B05B 15/622 248/87
1,178,558 A * 4/1916 Turner ..... A01K 97/10 248/302
2,517,937 A * 8/1950 Stanton ..... A01K 97/10 248/302
2,519,612 A * 8/1950 Tuttle ..... A01K 97/10 126/30
2,502,807 A * 9/1950 Temmer ..... A01K 1/04 248/156
2,522,223 A * 9/1950 Hardin ..... A47J 37/0763 126/30
2,932,511 A * 4/1960 Bemis ..... A63B 63/083 473/481
3,045,660 A * 7/1962 Manley ..... A47J 37/0763 126/30
3,076,557 A * 2/1963 Husted ..... A47J 37/0763 248/156
3,523,666 A * 8/1970 Bloodsworth ..... A01K 97/10 248/156
3,679,160 A * 7/1972 Ballenger ..... B65B 67/1205 248/101
3,749,253 A * 7/1973 Carter ..... A45F 3/44 211/171

(Continued)

*Primary Examiner* — Nkeisha Smith
(74) *Attorney, Agent, or Firm* — Royal Craig LLC

(57) ABSTRACT

A lawn stake holder for holding multiple backyard items including drink glasses, cans, wine glasses, corn hole bags, and horseshoes. The lawn stake holder generally comprises a unitary holder formed by bending a metal rod into a U-shaped yoke at the center, and bending a substantially-rectangular platform on one side of the U-shaped yoke, leaving a horizontal strut on the other side of the U-shaped yoke. The unitary holder is supported by a unitary lawn stake component formed from a single elongate rod with a pointed lower tip at one end for insertion into the ground, and a circular metal eye at the other end bent around the U-shaped yoke of the holder component. The holder component may be welded to the lawn stake component to secure it in place.

4 Claims, 3 Drawing Sheets

(56) References Cited

U.S. PATENT DOCUMENTS

| | | | | | |
|---|---|---|---|---|---|
| 3,956,846 | A * | 5/1976 | Kent | A01K 97/10 | 248/538 |
| 4,096,951 | A * | 6/1978 | Menssen | A47K 1/05 | 248/156 |
| D248,364 | S * | 7/1978 | Allen | D34/6 | |
| 4,591,420 | A * | 5/1986 | Van Horn | C25D 13/22 | 248/302 |
| 5,307,797 | A * | 5/1994 | Kleefeld | A47J 33/00 | 126/30 |
| 5,823,360 | A * | 10/1998 | Gorosave | A63B 71/0036 | 211/74 |
| 5,855,286 | A * | 1/1999 | Zaid | A47K 5/12 | 211/85.7 |
| 5,988,194 | A * | 11/1999 | Collins | E04H 15/62 | 52/156 |
| 6,419,592 | B1 * | 7/2002 | Player | A63B 55/10 | 248/688 |
| 6,640,797 | B1 * | 11/2003 | Magers | F24B 1/205 | 126/30 |
| 6,736,358 | B2 * | 5/2004 | Johnson | A45F 3/44 | 248/125.3 |
| 6,974,043 | B1 * | 12/2005 | Lai | A47K 17/00 | 211/205 |
| D530,768 | S * | 10/2006 | Rood | D21/796 | |
| 7,641,157 | B2 * | 1/2010 | Kirkendall | A45F 3/44 | 248/156 |
| 10,010,057 | B2 * | 7/2018 | Carlson | A01K 39/014 | |
| 11,083,333 | B2 * | 8/2021 | Pribyl | A47J 37/04 | |
| 11,812,874 | B2 * | 11/2023 | Coyne | A47G 23/0225 | |
| 2005/0016944 | A1 * | 1/2005 | Thorson | A47F 7/005 | 248/156 |
| 2012/0199705 | A1 * | 8/2012 | Will | A45F 3/44 | 248/121 |

* cited by examiner

MULTI-FUNCTION LAWN HOLDERS

CROSS-REFERENCE TO RELATED APPLICATIONS

The present application claims priority from U.S. Provisional Patent Application No. 63/402,542 filed Aug. 31, 2022.

BACKGROUND OF THE INVENTION

1. Field of the Invention

The present invention relates generally to backyard lawn accessories, and more specifically to multi-function lawn-stake holders for supporting cans, wine glasses, cornhole bags, horseshoes and the like in one's backyard.

2. Description of the Background

There are a variety of backyard leisure activities for entertaining family and friends. For example, games such as corn hole, horseshoes and the like entail throwing various objects at stationery targets. Refreshments are often enjoyed during such games, but it becomes cumbersome to walk from the game to the patio table to take a sip. It is equally cumbersome to drag a table to the game. It is far more convenient to use a portable stand to support beverage containers. However, existing lawn holders are single-purpose devices, e.g., lawn stakes designed to hold one or two cans at best.

What is needed is a multi-function lawn stake holder adept at holding a variety of often-used backyard items such as drink glasses, cans, wine glasses, corn hole bags, and horseshoes.

SUMMARY OF THE INVENTION

According to an embodiment of the invention, a multi-function lawn stake holder is provided to hold multiple backyard items including drink glasses, cans, wine glasses, corn hole bags, and horseshoes.

In accordance with the foregoing objects, the invention is a lawn stake holder, comprising 1) a unitary holder formed by bending a metal rod into a U-shaped yoke at the center, bending a substantially-rectangular platform on one side of the U-shaped yoke, leaving a horizontal strut on the other side of the U-shaped yoke; and 2) a unitary lawn stake component formed from a single elongate rod with a pointed lower tip at one end for insertion into the ground, and a circular metal eye at the other end bent around the U-shaped yoke of the holder component.

To assemble, the holder component is fully-formed first, and the lawn stake component is then bent around the holder component. Optionally, the holder component may be welded to the lawn stake component to secure it in place.

The present invention is described in greater detail in the detailed description of the invention, and the appended drawings. Additional features and advantages of the invention will be set forth in the description that follows, will be apparent from the description, or may be learned by using the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

Figure 1:
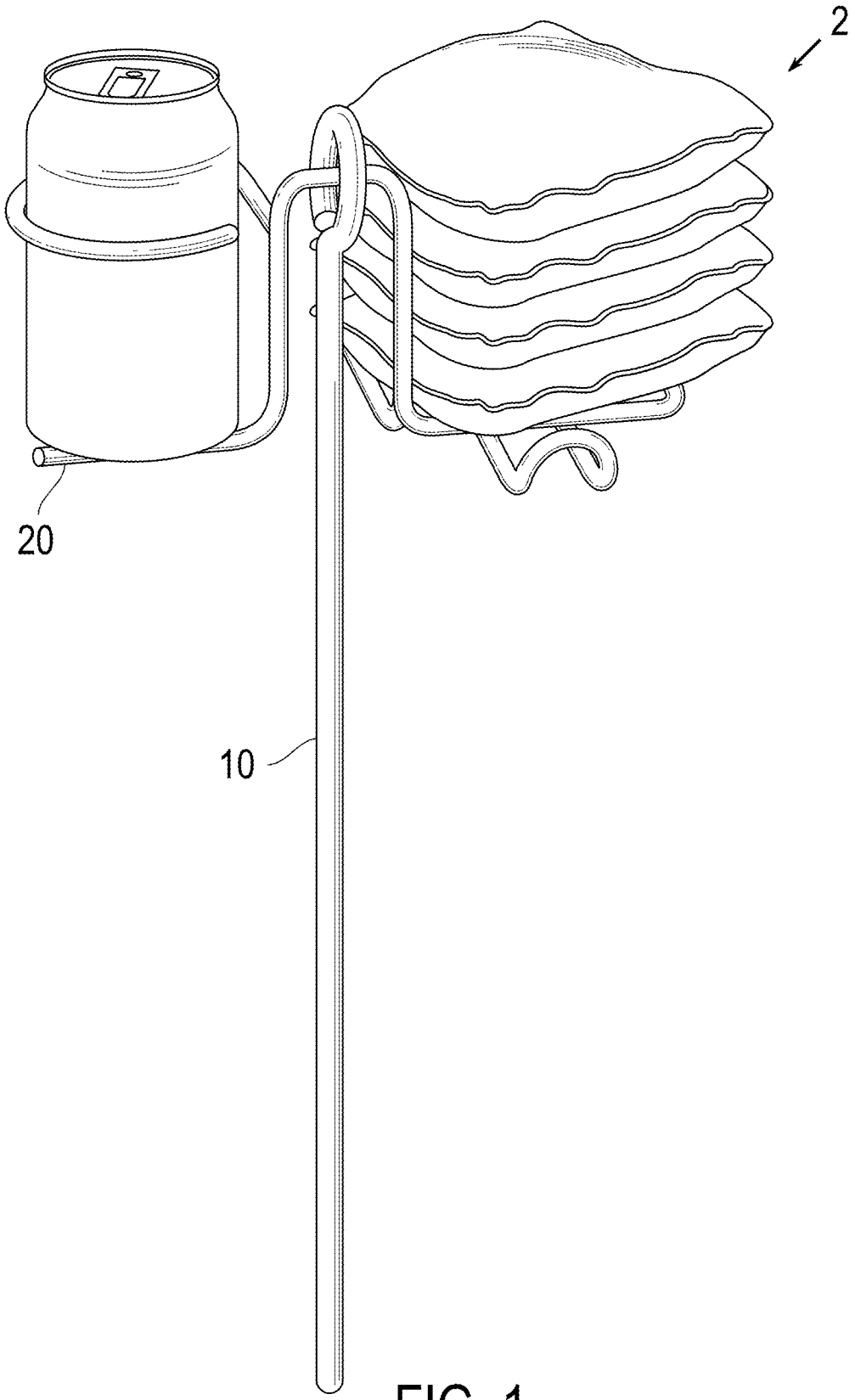
FIG. 1 is a perspective view of a multi-function lawn stake holder 2 according to the present invention.
Figure 2:
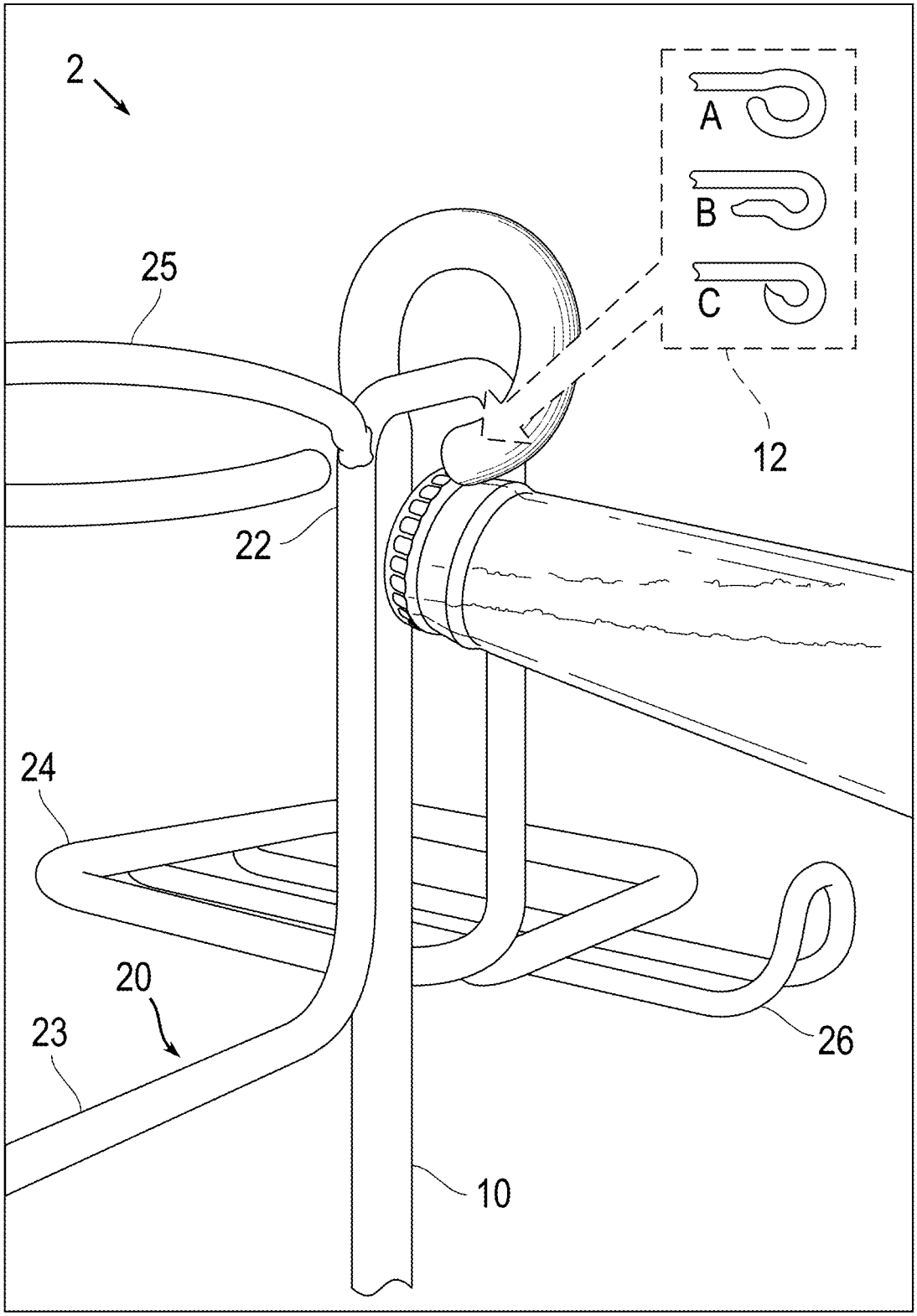
FIG. 2 is a close-up perspective view of the two components of the lawn stake holder 2 of FIG. 1: lawn stake component 10 and holder component 20.

The present invention generally is a multi-function lawn stake holder. With combined reference to FIGS. 1-2, the lawn stake holder 2 generally comprises two components: a lawn stake component 10 and a holder component 20. The lawn stake component 10 is an elongate 2-3' long metal stake with a pointed lower tip for insertion into the ground, and a circular metal eye 12 at top formed by bending the metal rod around in a circle of approximately 1" diameter. Importantly, as seen in FIG. 2, the metal rod is bent around and inward toward itself, leaving an angular gap that serves as a bottle opener. As seen in the upper inset of FIG. 2 the eye 12 |may be bent in several different ways to effectively function as a bottle opener, in each case capable of gripping the edge of a bottle cap and prying. For example, at A the metal rod is bent perpendicular to itself, leaving an angular gap with parallel faces. Alternatively, as seen at B and C the edge of the distal tip of the eye 12 may be extended (B) or angled (C) to provide a sharper bite against the bottle cap, improving effectiveness at gripping and removing the bottle cap.

The holder component 20 is likewise formed by bending a metal rod, including a U-shaped yoke 22 at the center, leaving a horizontal strut 23 one side, and bending a substantially-rectangular platform 24 on the other side. A circular collar 25 is welded proximate the peak of the U-shaped yoke 22 to provide lateral support for a glass or can inserted there through, the glass/can standing erect on the strut 23 cradled within collar 25. A medial hook 26 also formed by bending a rod in a U-shape, and the hook 26 is welded beneath the platform 24, twice-straddling the platform 24 so as to provide a floor. This way, the platform 24 serves as a second holder for corn hole bags or the like. In addition, the U-shaped tip of the medial hook 26 is turned upward to provide a hanging support for horseshoes or the like.

To assemble the lawn stake holder 2, the holder component 20 is fully-formed first. The a lawn stake component 10 is then bent around the holder component 20, again to within a quarter inch of itself, leaving the aforesaid gap as a bottle opener. The holder component 20 is counterbalanced, and may swing freely. Alternatively, the holder component 20 may be welded to the lawn stake component 10 to secure it in place.

Figure 3:
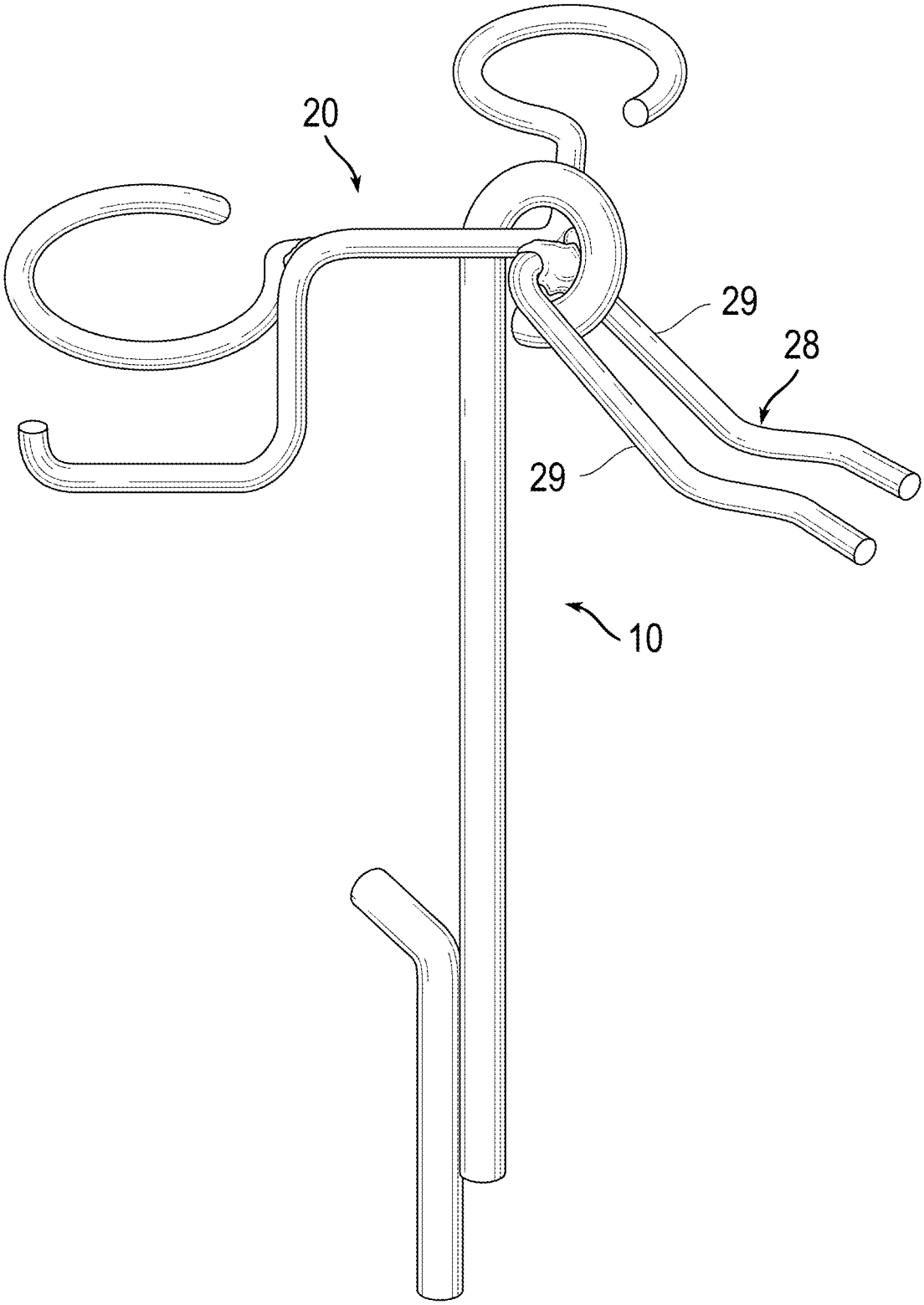
FIG. 3 is a perspective view of another embodiment in which a wine glass holder 28 is added to the holder component 20.

In another embodiment shown in FIG. 3, a wine glass holder 28 is added to the holder component 20. The wine glass holder 28 comprises two elongate bent-metal fingers 29 both secured at one end to the circular metal eye 12 at the top of the stake component 10. The fingers 29 are bent at a 90-degree angle, inserted into the eye 12, and welded thereto such that they are spaced apart approximately 1" and protrude parallel and horizontally from the top of the stake component 10. In addition, the tips of both fingers 29 are turned upward to bias the wine glass inward and prevent inadvertent spillage. A conventional wine glass is carried on the wine glass holder 28, the stem being inserted between the fingers 29 and the receptacle carried thereatop. The holder component 20 can be further modified by replacing the rectangular platform 24 of FIGS. 1-2 with a second glass/can holder inclusive of strut 23 and collar 25.

Assembly of the lawn stake holder 2 of FIG. 3 is the same, the holder component 20 is fully-formed first. The lawn stake component 10 is then bent around the holder component 20, again to within a quarter inch of itself, leaving the aforesaid gap as a bottle opener. The holder component 20 may be welded to the lawn stake component 10 to secure it in place.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A lawn stake holder, comprising:

a unitary holder component comprising a metal rod defined by an inverted U-shaped yoke, a substantially rectangular platform on one side of the U-shaped yoke, and a holder on the other side of the U-shaped yoke having a collar offset from a horizontal strut;

a unitary lawn stake component comprising a single elongate metal rod having a pointed lower tip at one end for insertion into the ground, and bent at the other end to define a circular metal eye surrounding the U-shaped yoke and thereby supporting the unitary holder component.

2. The lawn stake holder of claim 1, wherein the circular metal eye is formed by bending the metal rod around toward itself.

3. The lawn stake holder of claim 2, wherein the circular metal eye is formed by bending the metal rod around toward itself in a circle having approximately a 1" diameter.

4. The lawn stake holder of claim 2, wherein the circular metal eye is bent around and inward toward itself but leaving an angular gap that functions as a bottle opener.

* * * * *